United States Patent [19]

Frank

[11] Patent Number: 4,486,978

[45] Date of Patent: Dec. 11, 1984

[54] SKYLIGHT

[75] Inventor: Wilhelm Frank, Leinfelden, Fed. Rep. of Germany

[73] Assignee: Wilh. Frank GmbH, Leinfelden-Echterdingen, Fed. Rep. of Germany

[21] Appl. No.: 407,256

[22] Filed: Aug. 11, 1982

[51] Int. Cl.[3] ..... E05D 15/48

[52] U.S. Cl. ..... 49/153; 49/192; 49/390

[58] Field of Search ..... 52/72, 200; 49/390, 49/379, 386, 153

[56] References Cited

U.S. PATENT DOCUMENTS 3,977,134 8/1976 Bogaert ..... 49/379
4,055,024 10/1977 Frank ..... 49/390

FOREIGN PATENT DOCUMENTS 2421919 12/1974 Fed. Rep. of Germany ..... 49/390

*Primary Examiner*—Henry E. Raduazo
*Attorney, Agent, or Firm*—Kurt Kelman

[57] ABSTRACT

The novel arrangement relates to a skylight with a case and a wing mounted thereon for pivoting about a horizontal axis and swinging about a further horizontal axis, the swinging axis being partially constituted by axial pins at the sides of the wing which are displaceable while supported on the case, with a cover partially overlapping the wing and case, the cover being pivotally linked at one end to the case and at the other end at the wing, the axial pins being arranged between the linkages and the wing having a guard for covering the case at least in the range not overlapped by the cover, with at least one weight balancing device arranged on one of the longitudinal struts of the wing whose two-armed support lever pivotal about a bearing pin consists of a support arm carrying a roller and a tension arm to which a tension spring is linked which is adjustable by means of a tensioning device affixed to the wing.

5 Claims, 2 Drawing Figures

SKYLIGHT

SUMMARY OF THE INVENTION

Figure 1:
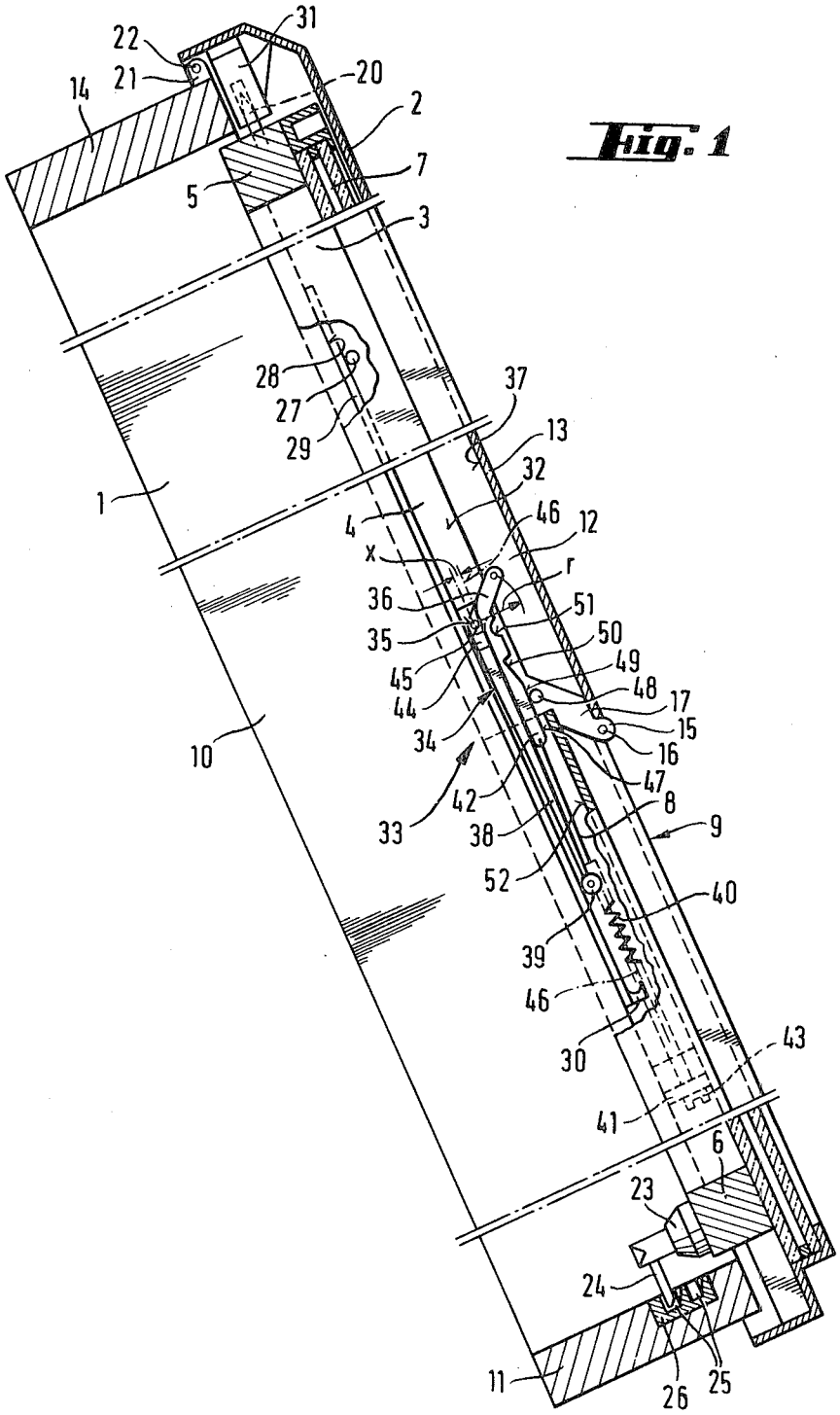

German Utility Model No. 7,514,306 discloses a skylight whose wing is selectively pivotally and swingably arranged on the case. When the wing is pivotally opened, it is unlatched from a cover and the axial pins glide downwardly along the case. During this movement, the angle between the cover and the wing increases and the pivoting axis is constituted in this movement by the axial pins in conjunction with the linkage of the cover to the wing. A pivotally arranged weight balancing device is provided on the inside of each longitudinally extending leg of the case and its spring-biased support lever presses with the free end thereof against the underside of the wing. This device serves to facilitate the opening movement of the wing and to hold the wing in its opened position. Since the weight balancing devices are mounted on the inside of the case, they project into the space defined thereby. It is also objectionable that the weight balancing device is still visible when the skylight is closed.

These disadvantages are avoided in the weight balancing device of German Utility Model No. 2,422,328 in which the two-armed support lever and the tension spring are mounted in a recess of the case. In the closed position of the wing, the support lever and the tension spring are superimposed so that a deep recess is required. To enable the weight balancing device to be in a covered arrangement, a certain minimum width of the longitudinal leg of the case is required. In this arrangement, the great height of the weight balancing device is disadvantageous since it requires a deep recess. Furthermore, a minimum gage of the longitudinal leg of the case is needed to enable the weight balancing device to be mounted therein.

It is the object of the novel arrangement to provide a skylight with a case and a wing pivotally and swingably mounted thereon, wherein the weight balancing weight provided with a tension spring has a small structural height and there is no recess for a covered arrangement.

This object is accomplished with a weight balancing device secured below the guard or cover on the outside of the longitudinal strut of the wing, the bearing pin of the support lever being arranged between the linkage points and the tension arm extending in the direction of the cover, the distance between the axis of the bearing pin and the longitudinal median plane of the tension spring being smaller than the swinging radius if the tension arm, a guide arm being pivotally arranged between the tension spring and tension arm and cooperating with a bolt fixedly arranged on the wing frame.

The heretofore required recess is made unnecessary because of the arrangement of the weight balancing device on the outside of the longitudinal strut of the wing in the space overlapped by the guard or cover. The optical impression of the skylight is also improved since the weight balancing device is no longer visible when the wing is closed. In particular, the tension spring is positioned outside the range of the support lever, for example laterally of the support lever and advantageously in the extension of the support lever so that there is little space requirement in the plane perpendicular to the plane of the wing and the structural height is thereby reduced. The tension spring and tension arm of the support lever are interconnected by a guide arm. Since the bearing pin forming the pivoting axis of the support lever is affixed to the wing above the linkage point of the cover to the wing, the pivoting radius of the tension arm is within the cover which is displaced with respect to the guard towards the upper side of the wing from the linkage point on so that the tension arm has sufficient free space for pivoting. The arrangement of the bolt on the wing, which is contacted by the guide arm, results in avoiding that the tension spring wipes over the underside of the guard in all positions of the wing. This results from the fact that the bolt as well as the tension spring is affixed to the wing and, therefore, the parallel position of the tension spring in relation to the guard is not changed despite the change in the angle between the support arm and the wing.

According to a preferred embodiment, the bolt is constituted by a roller bolt to reduce the friction between the guide arm and the bolt.

It is advantageous if the running surface of the guide arm in contact with the bolt has at least one notch. This results in a relative movement of the guide arm to the bolt by the pivoting movement of the support lever when the wing is opened. Accordingly, the bolt can move into the notch and may thus fix an intermediate opening position of the wing.

It is preferred that the guide arm contacts the narrow side of the support arm in the closed position of the wing and is oriented essentially parallel thereto and is bent partially in conformity with the cover in the range of the tension arm. This prevents the free end of the guide arm from projecting beyond the inner wing frame plane as the opening width increases.

According to a particularly preferred embodiment, the linkage point of the cover to the wing is provided with a fixing flange on which the support lever and the bolt are mounted. In this way, the support lever and the linkage point from a structural unit whereby the assembly is facilitated.

Figure 2:
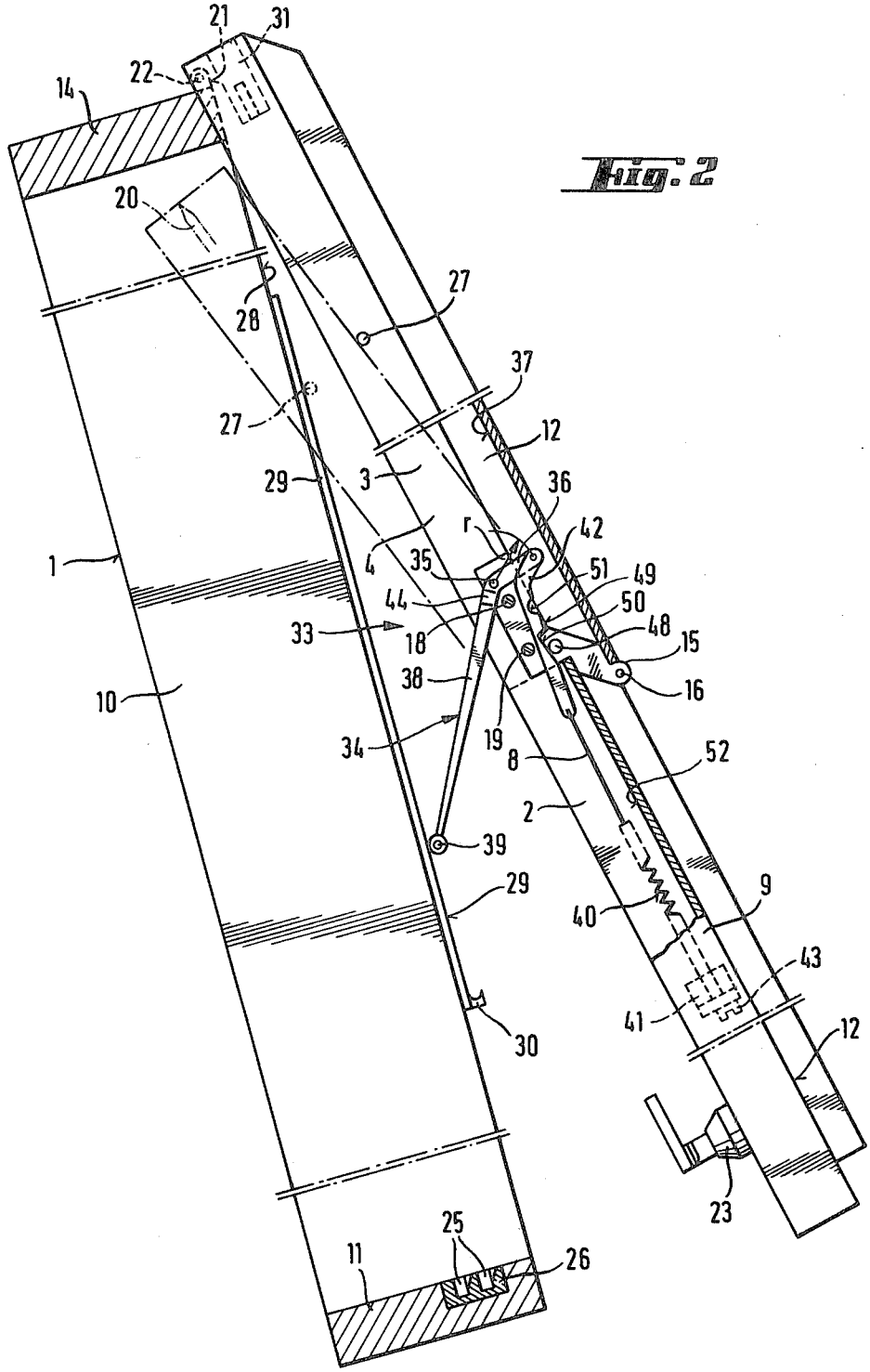

Further advantages and details of the subject matter of the novel arrangement can be gleaned from the drawings which show a schematic illustration of a preferred embodiment as an example and wherein FIG. 1 illustrates a skylight with a weight balancing device according to the invention in longitudinal section and in the closed position and FIG. 2 shows the skylight of FIG. 1, the wing being in the pivoted position.

Wing frame 3 of the skylight comprised of case 1 and wing 2 is constituted by longitudinal struts 4 and transverse struts 5, 6, and is provided with insulating glass 7. The outside 32 of wing frame 3 is covered by guard 9 affixed to wing frame 3, which covers the lower half of case 1, namely substantially from the center of longitudinal leg 10 and the lower transverse leg 11. One end of cover 13 is pivotally connected to wing 2 by a respective linkage point 15 substantially in the center of the length of longitudinal strut 4 of wing 2 and the other end thereof is pivotally connected to case 1 by linkage point 22 constituted by hinge 21, the upper transverse leg 14 of case 1 also being covered thereby. Cover 13 is equipped in the range of longitudinal leg 10 with a step 12 extending away from longitudinal leg 10. Linkage point 15 is provided with fixing flange 17 arranged perpendicular to axis 16 thereof and affixed to outside 32 of the wing frame by means of screws 18, 19. An operating lever 23 is arranged on the underside of wing 2 whose latch 24 engages one of the notches 25 of closing element 26 affixed to lower transverse leg 11 and which serves to control push rods 20 to enable wing 2 to be latched to, and unlatched from, cover 13 by means of locking piece 31.

Each longitudinal strut 4 of wing 2 carries axial pin 27 between linkage points 16, 22, which is in contact with guide rail 29 provided with nose 30 and affixed to end face 28 of longitudinal strut 10 of case 1.

Weight balancing device 33 is arranged on outside 32 of each longitudinal strut 4 of wing 2. It is arranged covered in the space between outside 32 of wing 2 and cover 13 or guard 9. Support lever 34 is mounted pivotally about bearing pin 35 on fixing flange 17 at the side of the wing and tension arm 36 thereof extends in the direction of underside 37 of cover 13. Long support arm 38 of support arm 34 has roller 39 in contact with guide rail 29. A respective tension spring 40 is arranged on longitudinal struts 4 close to the underside of wing 2, one end thereof being connected to tension device 41 while the other end is coupled with guide arm 42 pivotally mounted on tension arm 36. Set screw 43 of tension device 41 serves to adjust the desired biasing force of tension spring 40.

In the closed position, support arm 38 provided in the range of bearing pin 35 with bent 44 extends substantially parallel to longitudinal strut 4 and guide arm 42 pivoted to tension arm 36 is arranged in the range of bent 44 close to narrow side 47 of support arm 38. Tension spring 40 is affixed laterally displaced with respect to support arm 38 so that a small structural height is achieved. It is particularly advantageous in this arrangement to interpose intermediate arm 8 in the form of a wire between tension spring 40 and guide arm 42, which does not require much space and which enables support arm 38 and tension spring 40 to be arranged in a common plane one behind the other in the longitudinal direction. Distance x between axis 45 of bearing pin 35 and longitudinal center axis 46 of tension spring 40 is substantially smaller than swinging radius r of tension arm 36 so that a low structural height is achieved in the range of guard 9. There is sufficient swinging space for tension arm 36 in the range of cover 13 because of step 12.

Bolt 48 constituted by a roller pin is fixedly arranged on fixing flange 17 outside the movement range of tension arm 36 and guide arm 42 contacts the same with running surface 49 thereof which is provided with notches 50, 51. To open wing 2, wing 2 must be unlatched from case 1 by operating lever 23 and pivoted by a 90° movement and lifted. The opening movement is supported by the bias of tension spring 40 exerted upon support arm 38 and the wing is pivoted open while moving about linkage point 22, as shown in FIG. 2. As the opening width of wing 2 increases, tension spring 40 could assume a position so oblique with respect to guard 9 because of the pivoting movement of support arm 36 about bearing pin 35 that tension spring 40 wipes over underside 52 of guard 9. This is, however, prevented by fixed bolt 48 on the side of the wing, which keeps the distance between bolt 48 and affixing point of tension spring 40 constant.

To bring wing 2 into its swinging position, operating lever 23 must be pivoted 180° from the closed position of FIG. 1, which causes push rod 20 to be withdrawn from locking piece 31 and thus removes fixing of wing 2 to cover 13. When wing 2 is lifted, axial pins 27 glide downwardly along guide rail 29 and, at the same time, the angle between cover 13 and guard 9 is formed and increased. Bolt 48 also keeps tension spring 40 spaced from guard 9 in the swinging position when cover 13 is arranged oblique to guard 9.

I claim:

1. A skylight comprising a case, a wing mounted thereon for pivoting about a horizontal axis and swinging about a further horizontal axis, the wing including a frame with two longitudinal struts having respective outsides, pins projecting from the outsides of the wing and displaceable while supported on the case, the pins being arranged between the horizontal axes, a cover partially overlapping the wing and the case, the cover being linked at one end to the case and at an opposite end thereof to the wing, a guard on the wing for covering the case in the range not overlapped by the cover, a weight balancing device affixed below the guard and the cover on a respective outside of one of the longitudunal struts, a two-armed support lever pivotal about a bearing pin arranged between the horizontal axes and comprising a support arm carrying a roller, a tension arm extending in the direction of the cover, a tension spring linked to the tension arm and adjustable by a tensioning device affixed to the wing, the distance between the bearing pin and the longitudinal median plane of the tension spring being smaller than the pivoting radius of the tension arm, and a guide arm pivotally arranged between the tension spring and the tension arm to cooperate with a bolt fixedly arranged on the wing frame.

2. The skylight of claim 1, wherein the bolt is constituted by a rolling pin.

3. The skylight of claim 1, wherein the guide arm has a running surface in contact with the bolt, the running surface defining at least one notch.

4. The skylight of claim 1, wherein the support arm has a narrow side, the guide arm contacts the narrow side of the support arm in a closed position of the wing and extends substantially parallel to the support arm, the guide arm being partially bent in the range of the tension arm to cover the tension arm.

5. The skylight of claim 1, further comprising a fixing flange at the further horizontal axis, the fixing flange mounting the support lever and the bolt.

* * * * *